US010082022B2

(12) United States Patent
Brown-Kerr et al.

(10) Patent No.: US 10,082,022 B2
(45) Date of Patent: Sep. 25, 2018

(54) DOWNHOLE APPARATUS AND METHOD

(71) Applicant: Halliburton Manufacturing and Services Limited, Leatherhead, Surrey (GB)

(72) Inventors: William Brown-Kerr, Aberdeenshire (GB); Bruce Hermann Forsyth McGarian, Aberdeenshire (GB)

(73) Assignee: HALLIBURTON MANUFACTURING AND SERVICES LIMITED, Dyce, Aberdeen (GB)

( * ) Notice: Subject to any disclaimer, the term of this patent is extended or adjusted under 35 U.S.C. 154(b) by 439 days.

(21) Appl. No.: 14/406,265

(22) PCT Filed: Jul. 18, 2013

(86) PCT No.: PCT/GB2013/051919
§ 371 (c)(1),
(2) Date: Mar. 20, 2015

(87) PCT Pub. No.: WO2014/013256
PCT Pub. Date: Jan. 23, 2014

(65) Prior Publication Data

US 2015/0184506 A1 Jul. 2, 2015

(30) Foreign Application Priority Data

Jul. 19, 2012 (GB) ..... 1212849.2

(51) Int. Cl.
*E21B 47/18* (2012.01)
*E21B 34/06* (2006.01)
*E21B 47/00* (2012.01)

(52) U.S. Cl.
CPC ..... *E21B 47/185* (2013.01); *E21B 34/066* (2013.01); *E21B 47/00* (2013.01); *E21B 47/18* (2013.01)

(58) Field of Classification Search
CPC ..... E21B 47/185; E21B 47/187
See application file for complete search history.

(56) References Cited

U.S. PATENT DOCUMENTS 5,583,827 A 12/1996 Chin

FOREIGN PATENT DOCUMENTS

WO 2006041309 A1 4/2006
WO 2008127230 A2 10/2008
(Continued)

OTHER PUBLICATIONS

Written Opinion received in corresponding Singapore Application No. 11201408266V, dated Sep. 13, 2016.
(Continued)

*Primary Examiner* — Giovanna Collins Wright
(74) *Attorney, Agent, or Firm* — McDermott Will & Emery LLP

(57) ABSTRACT

An apparatus for generating a fluid pressure pulse downhole includes an elongate tubular housing defining an internal fluid flow passage. A first device is coupled to the housing for controlling a flow of fluid along a first flow path that communicates with the internal fluid flow passage to generate a first fluid pressure pulse. A second device coupled to the housing for controlling a flow of fluid along a second flow path that communicates with the internal fluid flow passage to generate a second fluid pressure pulse. The first and second devices are releasably mounted in corresponding spaces defined in a wall of the housing, and the first and second devices each house a valve having a valve element and a valve seat. The valve being actuatable to control the
(Continued)

flow of fluid along the first and second flow paths, respectively.

4 Claims, 6 Drawing Sheets

(56) References Cited

FOREIGN PATENT DOCUMENTS

| | | | |
|---|---|---|---|
| WO | 2011004180 | A2 | 1/2011 |
| WO | 2011014389 | A2 | 2/2011 |
| WO | 2014013256 | A1 | 1/2014 |

OTHER PUBLICATIONS

International Search Report and Written Opinion for PCT/GB2013/051919 dated Oct. 9, 2013.

DOWNHOLE APPARATUS AND METHOD

CROSS-REFERENCE TO RELATED APPLICATIONS

The present application is a national phase entry from International Patent App. Ser. No. PCT/GB2013/051919 filed on Jul. 18, 2013, which claims priority to UK Patent Appl. Ser. No. 1212849.2, filed on Jul. 19, 2012.

BACKGROUND

In the oil and gas exploration and production industry, a wellbore is drilled from surface utilizing a string of tubing carrying a drill bit. Drilling fluid known as drilling 'mud' is circulated down through the drill string to the bit, and serves various functions. These include cooling the drill bit and returning drill cuttings to surface along an annulus formed between the drill string and the drilled rock formations. The drill string is typically rotated from surface using a rotary table or top drive on a rig. However, in the case of a deviated well, a downhole motor may be provided in the string of tubing, located above the bit. The motor is driven by the drilling mud circulating through the drill string, to rotate the drill bit.

It is well known that the efficiency of oil and gas well drilling and completion operations can be significantly improved by monitoring various parameters pertinent to the process. For example, information about the location of the borehole is utilized in order to reach desired geographic targets. Additionally, parameters relating to the rock formation can help determine the location of the drilling equipment relative to the local geology, and thus correct positioning of subsequent wellbore-lining tubing. Drilling parameters such as Weight on Bit (WOB) and Torque on Bit (TOB) can also be used to optimize rates of penetration.

In particular, the drilling of a wellbore, preparation of a wellbore for production, and subsequent intervention procedures in a well involve the use of a wide range of different equipment. For example, a drilled wellbore is lined with bore-lining tubing which serves a number of functions, including supporting the drilled rock formations. The bore-lining tubing comprises tubular pipe sections known as casing, which are coupled together end to end to form a casing string. A series of concentric casing strings are provided, and extend from a wellhead to desired depths within the wellbore. Other bore-lining tubing includes a liner, which again comprises tubular pipe sections coupled together end to end. In this instance, however, the liner does not extend back to the wellhead, but is tied-back and sealed to the deepest section of casing in the wellbore. A wide range of ancillary equipment is utilized both in running and locating such bore-lining tubing, and indeed in carrying out other, subsequent downhole procedures. Such includes centralizers for centralizing the bore-lining tubing (and indeed other tubing strings) within the wellbore or another tubular; drift tools which are used to verify an internal diameter of a wellbore or tubular; production tubing which is used to convey wellbore fluids to surface; and strings of interconnected or continuous (coiled) tubing, used to convey a downhole tool into the wellbore for carrying out a particular function. Such downhole tools might include packers, valves, circulation tools and perforation tools, to name but a few.

For a number of years, measurement-whilst-drilling (MWD) has been practiced using a variety of equipment that employs different methods to generate pressure pulses in the mud flowing through the drill string. These pressure pulses are utilized to transmit data relating to parameters that are measured downhole, using suitable sensors, to surface 'real-time'. Systems exist to generate 'negative' pulses and 'positive' pulses. Negative pulse systems rely upon diverting a portion of the mud flow through the wall of the drill-pipe, which creates a reduction of pressure that can be detected at surface. Positive pulse systems normally use some form of poppet valve to temporarily restrict flow through the drill-pipe, which creates an increase in pressure that can be detected at surface. The pressure pulses are generated in the flow or supply side of the fluid system.

It will be evident from the above that there is a desire to provide information relating to downhole parameters pertinent to particular downhole procedures or functions, including but not limited to those described above. It is highly desirable to obtain 'real-time' feedback on these parameters, so that appropriate adjustments can be made during the operation in question. To this end, there have been proposals to transmit data relating to downhole parameters to surface via fluid pressure pulses. These include but are not limited to those measured in an MWD procedure. One apparatus suitable for this purpose is disclosed in the applicant's International Patent Publication No. WO-2011/004180. The apparatus incorporates a pulse generating device in a wall of a housing of the apparatus, so that a main bore of the housing is not impeded and remains open for the unrestricted passage of fluid, tubing or tools therethrough.

However, problems have been encountered in transmitting fluid pressure pulses to surface, particularly in larger diameter tubing, the pulses being of insufficient magnitude and so difficult to detect at surface. Problems have also been encountered where there are discontinuities in the inner bore diameter of various sections of the tubing (i.e. step changes in diameter). Problems have also been encountered in deep wells, due to signal attenuation. As a result, the data transmitted via the pulses can become lost. The present invention seeks to address these problems.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
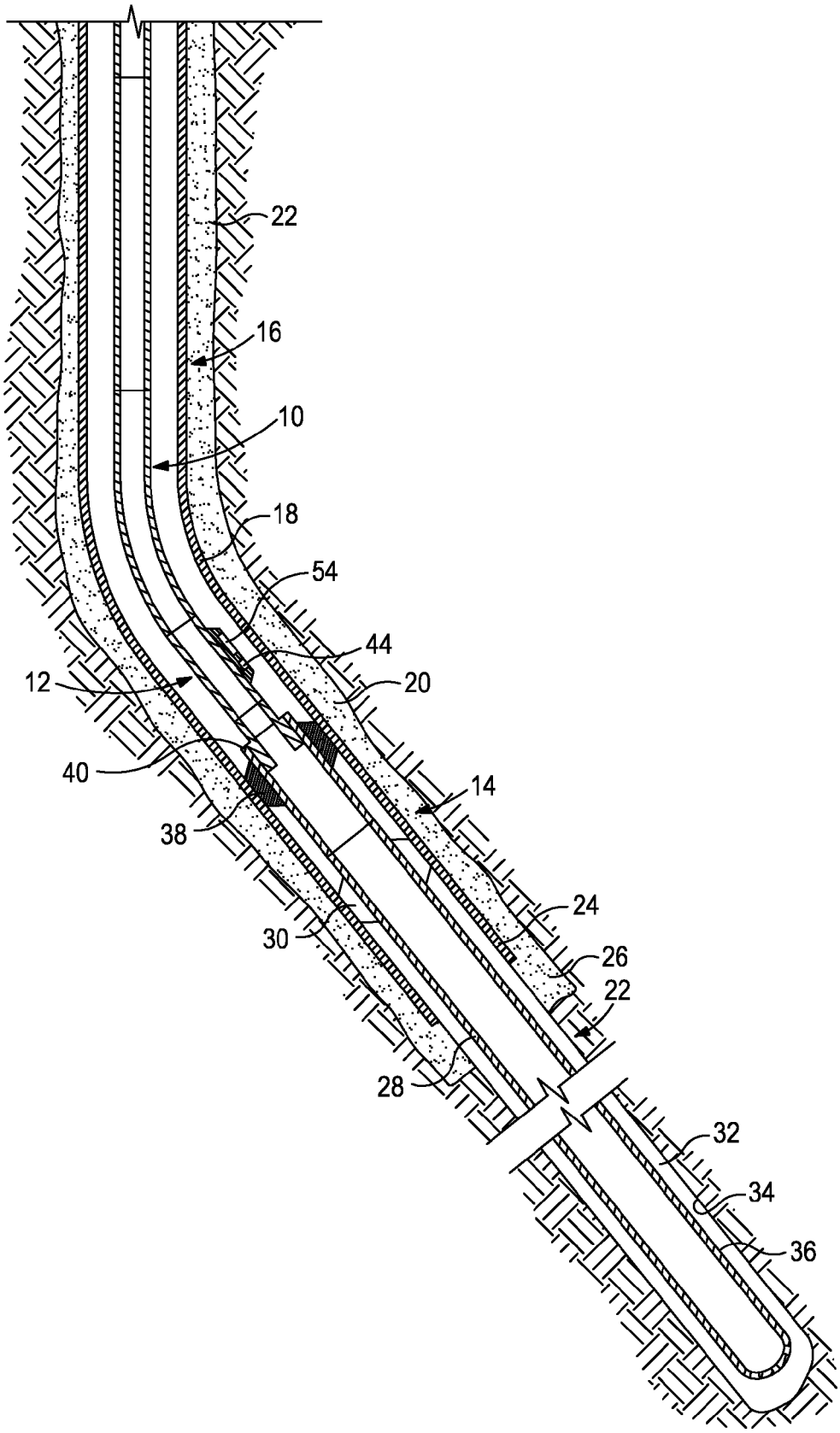
FIG. 1 is a schematic longitudinal sectional view of a downhole assembly, comprising apparatus for generating a fluid pressure pulse downhole, in accordance with an embodiment of the present invention, the apparatus shown in use during the completion of a well in preparation for the production of well fluids.

The present invention relates to apparatus for generating a fluid pressure pulse downhole. In particular, but not exclusively, the present invention relates to apparatus for generating a fluid pressure pulse downhole comprising an elongate, generally tubular housing defining an internal fluid flow passage, and a device for controlling the flow of fluid along a flow path which communicates with the internal fluid flow passage, to generate a fluid pressure pulse. The present invention also relates to a method of generating a fluid pressure pulse downhole.

According to a first aspect of the present invention, there is provided apparatus for generating a fluid pressure pulse downhole, the apparatus comprising: an elongate, generally tubular housing defining an internal fluid flow passage; a first device for controlling the flow of fluid along a first flow path which communicates with the internal fluid flow passage, to generate a first fluid pressure pulse; and a second device for controlling the flow of fluid along a second flow path which communicates with the internal fluid flow passage, to generate a second fluid pressure pulse; in which the first and second devices are both provided in the housing.

According to a second aspect of the present invention, there is provided apparatus for generating a fluid pressure pulse downhole, the apparatus comprising: an elongate, generally tubular housing defining an internal fluid flow passage; a first device for controlling the flow of fluid along a first flow path which communicates with the internal fluid flow passage, to generate a first fluid pressure pulse; and a second device for controlling the flow of fluid along a second flow path which communicates with the internal fluid flow passage, to generate a second fluid pressure pulse; in which the first and second devices are both provided in the housing, take the form of a cartridge which can be releasably mounted in a space provided in a wall of the tubular housing, and house a valve having a valve element and a valve seat, the valve being actuable to control the flow of fluid along the respective flow path.

The apparatus provides a number of advantages.

For example, the provision of the first and second devices in the same housing provides the ability to reduce the dimensions of the apparatus, in particular its length and weight, which offers advantages in terms of transporting, making-up and handling of the apparatus. The provision of the first and second devices in the same housing provide the ability to employ a common operating unit for the devices.

The second device may be arranged to generate a second fluid pressure pulse which matches the first fluid pressure pulse; and the first and second devices arranged to operate such that the fluid pressure pulse generated by the apparatus is a combination of the first and second fluid pressure pulses generated by the first and second devices. The first and second devices may be arranged to operate simultaneously. The devices can thus be operated together, to effectively provide a boosted pressure pulse.

The first and second devices may be arranged so that they do not impede the internal fluid flow passage defined by the housing. The first and second devices may be mounted in a space, or in respective spaces, which may be provided in a wall of the tubular housing. The space may have an opening which is on or in an external surface of the housing. This may facilitate insertion of the device(s) into the space.

It is conceivable that a pulse of a magnitude sufficient to be detected at surface could be generated by increasing the dimensions of a flow path controlled by a pulse generating device, this requiring the corresponding provision of a larger/more powerful device. However, a significant problem with such a proposal is the restriction on space which exists downhole in a well, particularly where the device is to be arranged so that it does not impede the internal fluid flow passage. This impacts upon the ability to increase flow path dimensions, because of the restriction on the space available to house a larger pulse generating device.

In particular, there is a need to direct tubing, tools or other equipment into the well downhole of the pulse generating device, but this might not be possible where a larger device is employed which would impede the bore of tubing in which the device is located.

One advantage of the present invention is that a fluid pressure pulse can be generated which is the sum of pulses generated by first and second devices, which do not take up significant space downhole. In particular, the devices may not take up as much space, at least in a radial direction, as would a single device issuing a pulse of similar magnitude. Accordingly, a pulse of a magnitude which is sufficient to be detected at surface can be generated without requiring the use of a larger pulse generating device which might otherwise impede the internal flow passage of the housing.

The arrangement of the devices, so that the pulses they generate match, is such that the pulses can complement and/or reinforce one-another. The pulses generated by the devices may match in that they have the same profiles or signatures (pressure v. time). In this way, the pulse outputted by the apparatus has a magnitude (or amplitude) which is the sum of the magnitudes of the individual pulses generated by the first and second devices.

The second device can be arranged so that it is operated independently of the first device. This may provide a degree of redundancy in the event of failure of the first device, without requiring the apparatus to be returned to surface for repair.

The first and second devices can be arranged so that they are used to transmit pressure pulses to surface representative of the same data, but transmitted using different pulse profiles or signatures (pressure v. time). This may provide an ability to take account of particular operating conditions in the well affecting pulse transmission. For example, operating conditions including wellbore temperature and pressure, the density and/or viscosity of fluids in the wellbore-lining tubing, and the presence of solids materials such as drill cuttings, may impact on the transmission of fluid pressure pulses to surface. A pulse of a different duration and/or amplitude may be more effectively transmitted (and so detected at surface) depending upon these operating conditions. Thus the data to be transmitted by the apparatus can effectively be transmitted in more than one different way.

The first and second devices can be arranged so that they are used to transmit pressure pulses to surface representative of different data, such as relating to different downhole parameters. Such parameters can include pressure, temperature, WOB, TOB, stress or strain in wellbore tubing or data relating to geological features.

The first and second devices may both be mounted on or in the housing. The first and second devices may be mounted in a side-by-side or parallel orientation.

The devices may be arranged at a common axial position along a length of the tubular housing. The first and second flow paths may each have a respective inlet and outlet. The inlet of each flow path may be at a common axial position along a length of the tubular housing. The outlet of each flow path may be at a common axial position along a length of the tubular housing. The common axial positioning of the devices/inlets/outlets may facilitate matching of the pulses generated by the first and second devices.

The apparatus may further comprise an operating unit arranged to operate the first and/or second devices. The operating unit may be arranged to operate both devices, and may be arranged to operate the devices simultaneously or independently. The operating unit may comprise a source or sources of electrical power (such as a battery), a data acquisition system, sensor(s) and first and second connector elements which serve for electrically coupling the power source(s) to the respective first and second devices and for communicating with the devices.

The first and second devices may each comprise a valve having a valve element and a valve seat, the valve being actuable to control the flow of fluid along the respective flow path. This may be achieved by moving the respective valve elements into or out of sealing abutment with the valve seats. The first and second devices may comprise actuator elements which are operable to move the valve elements to thereby control the flow of fluid through the respective flow paths. The actuator elements may be electrically operated (and may for example be solenoids or motors) and coupled to the source of electrical power in the operating unit.

Positive or negative fluid pressure pulses may be generated by the devices. Positive pulses may be generated by operating the devices to close the respective flow paths, and negative pulses by operating the devices to open the flow paths.

The apparatus may comprise at least one further device for controlling the flow of fluid along a further flow path which communicates with the internal fluid flow passage, to generate a further fluid pressure pulse. The further device may be operated as described above in relation to the first and second devices. Accordingly and by way of example, the further device may be arranged so that it generates a further fluid pressure pulse which matches the first and second pulses. In this way, a pulse of greater magnitude can be outputted by the apparatus, which is the sum of the pulses generated by the first, second and further devices. If desired, four or more such devices may be provided and so arranged. The further device(s) may have any of the features set out herein in relation to the first/second devices.

The operating unit may be arranged so that it does not impede the internal fluid flow passage defined by the housing. The operating unit may be mounted in a space which may be provided in a wall of the tubular housing, and which may be separate from the space or spaces in which the first and second devices are mounted. The devices and/or the operating unit may be mounted entirely within the space(s).

The tubular housing may define an upset, shoulder or the like, which may be upstanding from a circumferential outer surface of the housing, and which may define the space or spaces. This may facilitate the provision of an internal passage of unrestricted diameter (or other dimension) extending along a length of the housing. Alternatively a separate upset or shoulder component may be provided which defines the space or spaces, and which can be coupled to the housing.

The first and second devices may be in the form of a cartridge or insert which can be releasably mounted on, in or to the tubular housing, optionally in said space or spaces. The cartridges of the first and second devices may house the respective valves. The operating unit may be in the form of a cartridge or insert which can be releasably mounted on, in or to the tubular housing, optionally in said space.

The first and second devices, in particular the cartridge or insert, may define at least part of the respective flow paths. The devices, in particular the cartridge or insert, may define the outlets. The devices, in particular the cartridge or insert, may define the inlets to the respective flow paths, or may define device inlets which communicate with the flow path inlets.

The inlet of each flow path may open on to the internal fluid flow passage. The outlet may open on to an exterior of the housing. The outlet may open on to the internal fluid flow passage at a position which is spaced axially along a length of the housing from the inlet. In use, the generation of fluid pressure pulses may be achieved without restricting a bore of the primary fluid flow passage. The generation of positive or negative pulses may be controlled by appropriate direction of fluid to an exterior of the housing or back into the internal flow passage. The direction of fluid back into the internal flow passage may require the existence of a restriction in the fluid flow passage defined by the housing.

According to a third aspect of the present invention, there is provided a method of generating a fluid pressure pulse downhole, the method comprising the steps of: locating an elongate, generally tubular housing defining an internal fluid flow passage downhole in a well; providing a first device in the housing, the device controlling the flow of fluid along a first flow path which communicates with the internal fluid flow passage; providing a second device in the housing, the device controlling the flow of fluid along a second flow path which communicates with the internal fluid flow passage; and operating the first and second devices to control the flow of fluid along the respective flow paths and thereby generate corresponding first and second fluid pressure pulses.

According to a fourth aspect of the present invention, there is provided a method of generating a fluid pressure pulse downhole, the method comprising the steps of: locating an elongate, generally tubular housing defining an internal fluid flow passage downhole in a well; releasably mounting a first device in a space provided in a wall of the housing, the device taking the form of a cartridge housing a valve having a valve element and a valve seat, the valve being actuable to control the flow of fluid along a first flow path which communicates with the internal fluid flow passage; releasably mounting a second device in a space provided in a wall of the housing, the device taking the form of a cartridge housing a valve having a valve element and a valve seat, the valve being actuable to control the flow of fluid along a second flow path which communicates with the internal fluid flow passage; and operating the first and second devices to control the flow of fluid along the respective flow paths and thereby generate corresponding first and second fluid pressure pulses.

The method may comprise operating the first and second devices simultaneously. The method may comprise arranging the first and second devices so that the first and second pressure pulses match, and so that a fluid pressure pulse outputted by the apparatus is a combination of the first and second fluid pressure pulses generated by the first and second devices. The devices may be arranged so that the pulses generated by the devices complement and/or reinforce one-another.

The second device may be operated independently of the first device and in the event of failure of the first device.

The first and second devices may be operated with a time delay, such as between operation of the first device and operation of the second device (or vice-versa), or in a staggered fashion.

The method may be a method of transmitting data relating to at least one downhole parameter to surface via the combined fluid pressure pulses.

The first and second devices may be operated to transmit pressure pulses to surface representative of the same data, but using different pulse profiles.

The first and second devices may be operated to transmit pressure pulses to surface representative of different data, such as relating to different downhole parameters.

The devices may be operated by an operating unit, which may operate the first and second devices simultaneously or independently.

The method may comprise providing at least one further device for controlling the flow of fluid along a further flow path which communicates with the internal fluid flow passage; operating the first, second and further devices to control the flow of fluid along the respective flow paths and thereby generate corresponding first, second and further pressure pulses. The further device may be operated as described above in relation to the first and second devices. Accordingly and by way of example, the further device may be operated to generate a further fluid pressure pulse; and the method may comprise arranging the devices so that the first, second and further pressure pulses match, and so that a fluid pressure pulse outputted by the apparatus is a combination of the first, second and further fluid pressure pulses generated by the devices.

Further features of the method may be derived from the text above relating to the first and/or second aspect of the invention.

According to a fifth aspect of the present invention, there is provided apparatus for generating a fluid pressure pulse downhole, the apparatus comprising: an elongate, generally tubular housing defining an internal fluid flow passage; a first device for controlling the flow of fluid along a first flow path which communicates with the internal fluid flow passage, to generate a first fluid pressure pulse; and a second device for controlling the flow of fluid along a second flow path which communicates with the internal fluid flow passage, to generate a second fluid pressure pulse which matches the first fluid pressure pulse; in which the first and second devices are arranged to operate such that the fluid pressure pulse generated by the apparatus is a combination of the first and second fluid pressure pulses generated by the first and second devices.

Further features of the apparatus of the fifth aspect of the invention may be derived from the text above relating to the first and/or second aspect of the invention.

A method of generating a fluid pressure pulse downhole may also be provided having steps corresponding to the features defined in the fifth aspect of the invention.

Turning firstly to FIG. 1, there is shown a downhole assembly indicated generally by reference numeral 10, the assembly comprising an apparatus for generating a fluid pressure pulse downhole in accordance with an embodiment of the present invention and which is indicated generally by reference numeral 12. As will be described in more detail below, the apparatus 12 has a particular utility in transmitting data relating to one or more parameters measured in a downhole environment to surface.

In the illustrated embodiment, the assembly 10 takes the form of a tubing string and is shown in use, during the completion of a wellbore or borehole 14. In the drawing, a main portion 16 of the wellbore 14 has been drilled from surface, and lined with wellbore-lining tubing known as casing 18, which comprises lengths or sections of tubing coupled together end-to-end. The casing 18 has been cemented in place at 20, in a known fashion. The wellbore 14 has then been extended, as indicated by numeral 22, by drilling through a section of tubing 24 at the bottom of the wellbore (known as a casing 'shoe') and through a cement plug 26 which surrounds the casing shoe.

A smaller diameter wellbore-lining tubing known as a liner 28 has then been installed in the extended portion 22 of the wellbore, suspended from the casing 18 by means of a liner hanger 30. The liner 28 is shown prior to cementing in place, cement used to seal the liner (not shown) passing up an annulus 32 defined between a wall 34 of the drilled wellbore and an external surface 36 of the liner. The cement passes up along the annulus 32 and into the casing 24, at a level which is below (i.e. deeper in the well) the liner hanger 30. The liner hanger would then be set by conventional methods. A sealing device known as a packer 38 can then be operated to seal the upper end 40 of the liner 28 (i.e. that which is further uphole towards the surface). The liner 28 is run into the extended portion 22 of the well by means of the tubing string 10 which, in the illustrated embodiment, is a liner running string 10. The running string 10 also provides a pathway for the passage of cement into the liner 28 to seal the annulus 32, and for actuating the liner hanger 30 and packer 38.

The apparatus 12 of the present invention is incorporated into the string 10, and so run into the wellbore 14 with the liner 28. As will be described below, the apparatus 12 serves for sending data relating to one or more downhole parameter to surface real-time, to facilitate completion of the well (by installing the liner 28), and preparation of the well for production. In the illustrated embodiment, the data which is recovered to surface relates to the compressive load applied to item 40. As will be understood by persons skilled in the art, data relating to such parameters is vital to ensuring correct drilling and completion of the well shown, for accessing a subterranean formation containing well fluids (oil and/or gas).

To this end, the apparatus 12 also carries a sensor acquisition system 42 which is provided in an operating unit 44 of the apparatus. The acquisition system 42 includes suitable sensors (not shown) of known types, for measuring the compressive load on the liner 28. The operating unit 44 includes suitable electronics which stores the data, relays the data to the transmitting device 50, and provides power for operation of the apparatus 12. In this way, the compressive load measured by the sensors in the sub 42 can be transmitted to surface via the apparatus 12. As will be described below, separate sensors may be provided and coupled to the apparatus 12, for transmitting data relating to various downhole parameters to surface. The sensors may be provided in separate components in the string 10 and coupled to the apparatus 12.

The apparatus 12 will now be described in more detail with reference also to FIGS. 2 and 3, which are enlarged, detailed side and perspective views of the apparatus.

The apparatus 12 comprises an elongate, generally tubular housing 46 defining an internal fluid flow passage 48. A first pulse generating device 50 is mounted in the housing 46, and serves for controlling the flow of fluid along a first flow path 52 which communicates with the internal fluid flow passage 48, to generate a first fluid pressure pulse. A second pulse generating device 54 is similarly mounted in the housing 46, and serves for controlling the flow of fluid along a second flow path 56 which also communicates with the internal fluid flow passage 48, to generate a second fluid pressure pulse. Only part of the flow paths 52 and 56 are shown in FIGS. 2 and 3.

The first and second devices 50 and 54 can be arranged to operate in a number of operating conditions.

In one operating condition, the first and second devices 50 and 54 are arranged to operate such that the fluid pressure pulse generated by the apparatus 12 is a combination of the first and second fluid pressure pulses generated by the first and second devices. Arrangement of the devices 50 and 54 so that the pulses they generate match, is such that the pulses complement and/or reinforce one-another. The pulses generated by the devices 50 and 54 match in that they have the same profiles. In this way, the pulse outputted by the apparatus has a magnitude (or amplitude) which is the sum of the magnitudes of the individual pulses generated by the first and second devices 50 and 54. The invention therefore addresses the problems which have been encountered in the industry during the transmission of fluid pressure pulses to surface, particularly in larger diameter tubing and deep wells, where the pulses are of insufficient magnitude or suffer significant attenuation, and so are difficult to detect at surface.

In another operating condition, the second device 54 can be arranged so that it is operated independently of the first device 50 and in the event of failure of the first device. This provides a degree of redundancy in the event of failure of the first device 50, without requiring the entire apparatus 12 to be pulled out of the wellbore 14 and returned to surface for repair.

In another operating condition, the first and second devices 50 and 54 can be arranged so that they are used to transmit pressure pulses to surface representative of different data, such as relating to different downhole parameters (or the same parameters measured at different times). Such parameters can include pressure, temperature, WOB, TOB, stress or strain in wellbore tubing or data relating to geological features. Other parameters might be measured. When operated in this way, the devices 50 and 54 will be activated separately so that the pulses generated do not overlap. This will ensure that the two pressure pulse signals can be distinguished at surface. By way of example, the first device 50 may operate to generate a pulse of a first duration to transmit the data and then be deactivated. The second device 54 may then be operated to generate a pulse of a second duration and then be deactivated. Further pulses can be sent as appropriate.

In another operating condition, the first and second devices 50 and 54 can be arranged so that they are used to transmit pressure pulses to surface representative of the same data, but transmitted using different pulse profiles or signatures (pressure v. time). This may provide an ability to take account of particular operating conditions in the well affecting pulse transmission. For example, operating conditions including wellbore temperature and pressure, the density and/or viscosity of fluids in the wellbore-lining tubing, and the presence of solids materials such as drill cuttings, may impact on the transmission of fluid pressure pulses to surface. A pulse of a different duration and/or amplitude may be more easily transmitted (and so detected at surface) depending upon these operating conditions. Thus the data to be transmitted by the apparatus can effectively be transmitted in more than one different way. Again, when operated in this way, the devices 50 and 54 will be activated separately so that the pulses generated do not overlap. This will ensure that the two pressure pulse signals can be distinguished at surface.

Figure 4:
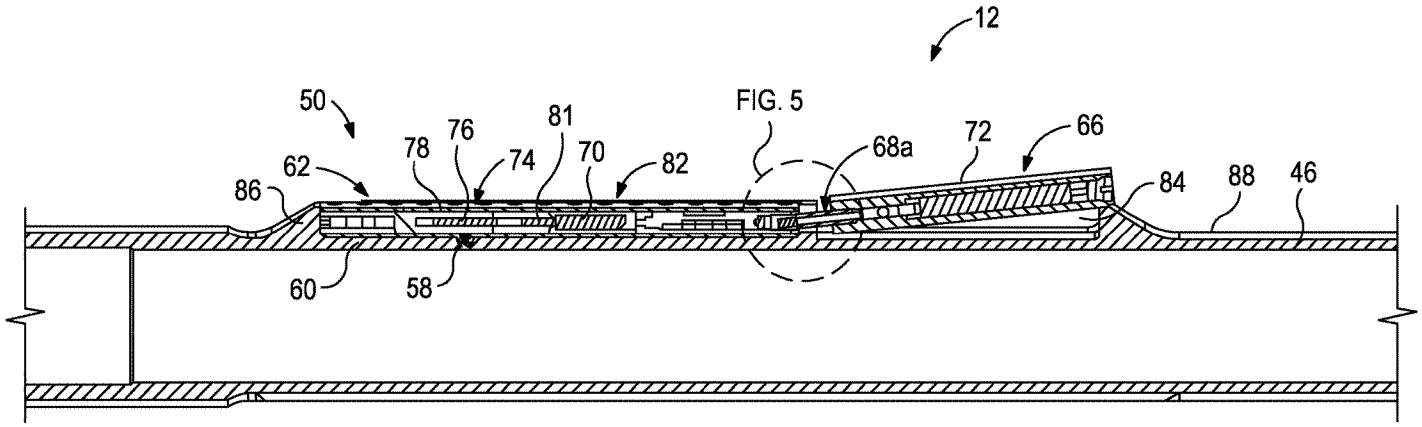
FIG. 4 is an enlarged, detailed view of the apparatus shown in FIG. 1.
Figure 5:
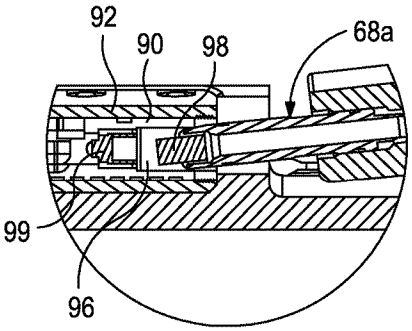
FIG. 5, presented on the same sheet as FIG. 4, is a further enlarged view of another part of the apparatus shown in FIG. 4.
Figure 4A:
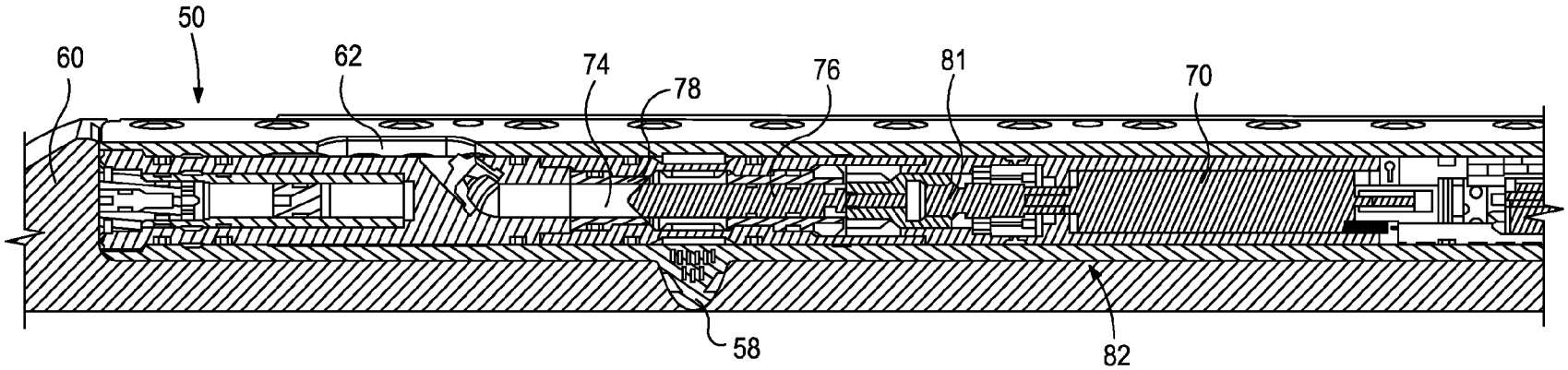
FIG. 4A is a further enlarged view of part of the apparatus shown in FIG. 4.

As can be seen particularly from the enlarged sectional view of FIG. 4, the further enlarged view of FIG. 4A, and the detail view of FIG. 5, the devices 50 and 54 do not take up significant space downhole, and do not impede the internal flow passage 48. In this way, access to the wellbore 14 downhole of the apparatus 12 can be achieved, such as for the passage of tools or tubing required in the well completion procedure. The devices 50 and 54 do not take up as much space, at least taken terms of their radial width, as a single device performing the same function would do. In this way, a pulse of a magnitude which is sufficient to be detected at surface can be generated without requiring the use of a larger pulse generating device, which might otherwise impede the internal flow passage 48.

The first and second devices 50 and 54 are both mounted in the housing 46. As can be seen particularly from FIG. 2, the devices 50, 54 are mounted in a side-by-side or parallel orientation. This facilitates simultaneous operation of the devices 50 and 54 by the operating unit 44. Other concentric mounting configurations may be employed whereby the devices 50 and 54 are positioned around the housing 46. For example, the devices 50 and 54 may be at 90°, 180° or other angular spacings. The first and second flow paths 52 and 56 each have respective inlets and outlets. FIGS. 4 and 4A show an inlet 58 of the first device 50, which is a port in a wall 60 of the housing 46. The second device 54 includes a similar such inlet (not shown). FIGS. 2 and 3 show respective outlets 62 and 64 of the devices 50 and 54, which are inclined relative to a main axis of the housing 46 so that, in use, fluid exiting the devices is jetted in an uphole direction, along the wellbore 14 to surface. As will be understood from the drawings, the inlets 58 of each flow path 52 and 56, and the outlets 62 and 64 of each flow path, are therefore at common axial positions along the length of the housing 46. In this way, the pulses generated by the devices 50 and 54 are effectively 'inserted' into the fluid in the wellbore 14 at common positions.

Figure 7:
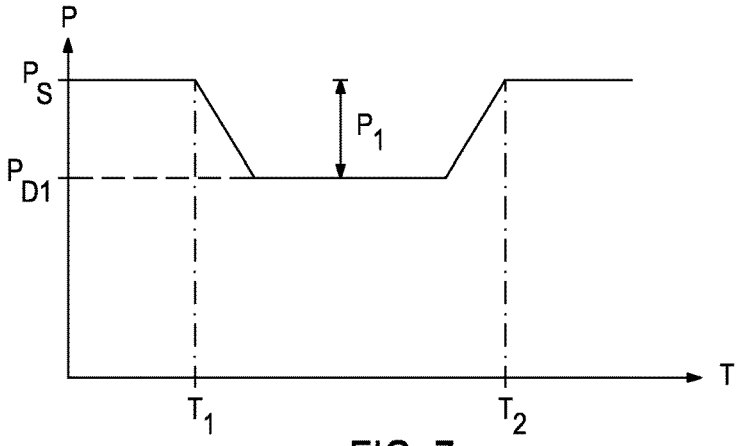
FIGS. 7 and 8 are graphs illustrating exemplary pressure profiles in a wellbore during operation of first and second pulse generating devices, respectively, of the apparatus of FIG. 1.
Figure 8:
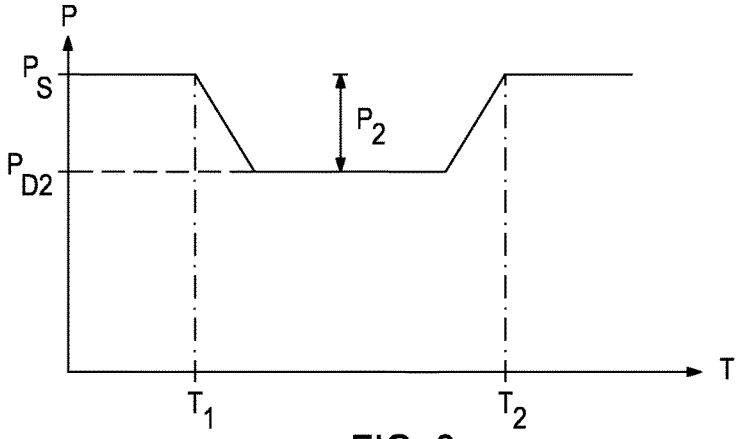

FIGS. 7 and 8 are graphs illustrating an exemplary pressure profile in a wellbore during operation of the first and second devices 50 and 54, respectively. It will be understood that the pulses are highly schematic, and that in practice a train of pressure pulses will typically be generated to transmit the data. The apparatus 12 is, in this instance, operating according to the first operating condition described above, where the devices 50 and 54 are operated simultaneously and the pulses combined. As can be seen, the graphs illustrate the devices during the generation of negative pressure pulses, resulting from flow through the respective flow paths 52 and 56 being initially prevented, and the devices then operated to permit flow along the flow paths.

The graphs assume stable operating conditions in the wellbore 14 at commencement, indicated by a starting pressure PS in the graphs, and separate operation of the devices 50 and 54. At a time T1, the devices 50 and 54 are operated to open flow through the respective flow paths 52 and 56. In the case of the device 50 (FIG. 7), this results in a drop of the pressure in the fluid in the wellbore from pressure PS to a level PD1. The magnitude of the pressure pulse generated by the device 50 is indicated as P1 in the graph, where P1=PS−PD1. In the case of the device 54 (FIG. 8), this results in a drop of the pressure in the fluid in the wellbore from pressure PS to a level PD2. The magnitude of the pressure pulse generated by the device 54 is indicated as P2 in the graph, where P2=PS−PD2. The pulses each have a similar duration, commencing at time T1 (where the flow paths 52 and 56 are fully open) and finishing at time T2 (where the flow paths are fully closed).

Figure 9:
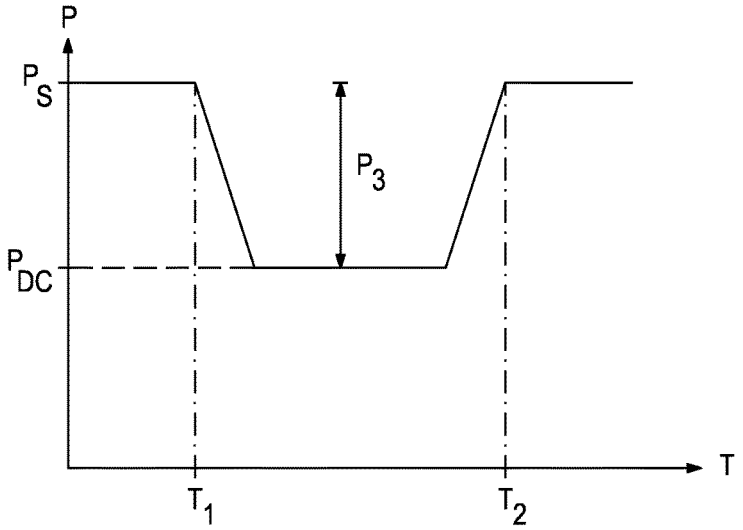
FIG. 9 is a graph illustrating a pressure profile in the wellbore during simultaneous operation of the first and second devices, and so illustrating a pressure pulse generated by the apparatus.

FIG. 9 is a graph illustrating a pressure profile in the wellbore 14 during simultaneous operation of the first and second devices 50 and 54 in the first operating condition, and so illustrating a resultant, combined pressure pulse outputted by the apparatus 12. This pressure pulse has a magnitude P3, where P3=PS−PDC (PDC being the combined pressure drop). As will be understood from the above, the pulse P3 is the sum of the pulses P1 and P2 shown in FIGS. 7 and 8.

Consequently, a pulse having a magnitude which, depending on parameters including the composition of fluid in the wellbore and physical factors, may be equal to twice the magnitude of the individual pulses generated by each of the devices 50 and 54, is generated. This is achieved employing devices 50, 54 which do not take up a greater proportion of the radial space available downhole, and which do not impede the housing bore 48.

The apparatus 12 and its method of operation will now be described in more detail.

Figure 6:
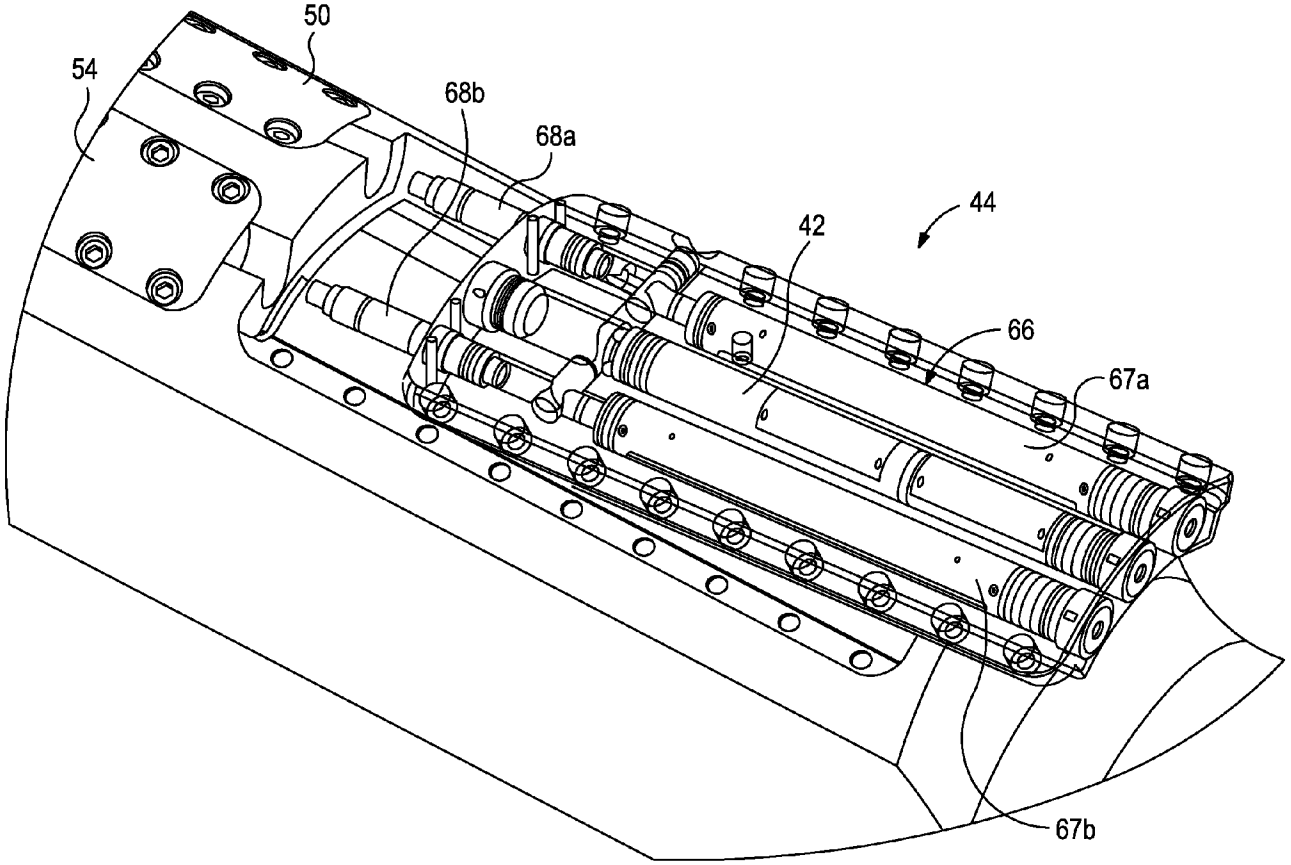
FIG. 6 is a further enlarged perspective view of part of the apparatus shown in FIG. 4, with certain internal components shown in ghost outline.

As discussed above, the apparatus 12 comprises the operating unit 44, which is arranged to operate the first and second devices 50 and 54 simultaneously or individually, as required. The operating unit 44 is shown in more detail in FIG. 6, which is a further enlarged perspective view of part of the apparatus shown in FIG. 4, with certain internal components shown in ghost outline and showing the operating unit during insertion into the housing 46. The operating unit 44 includes an electronics section 66 which comprises the sensor acquisition system 42, first and second electrical power sources in the form of batteries 67*a* and 67*b*, first and second electrical connector elements 68*a*, 68*b* and a suitable data storage device (not shown). The batteries 67*a* and 67*b* provide power for actuation of the devices 42, 50 and 54, respectively, although a single battery may be utilized. The connector elements 67*a*, 67*b* provide electrical connection with the devices 50 and 54 so that they can be operated to transmit data relating to parameters measured by sensors in the sensor acquisition system 42 to surface.

The first and second devices 50 and 54 each comprise a valve, one of which is shown and given the reference numeral 74. The valves 74 comprise a valve element 76 and a valve seat 78, the valves being actuable to control the flow of fluid along the respective flow paths 52, 56. This is achieved by moving the respective valve elements 76 into or out of sealing abutment with the valve seats 78. The devices 50 and 54 also each include respective actuators 70 coupled to the valve elements 76, to thereby control the flow of fluid through the respective flow paths 52, 56. The actuators 70 are electrically operated, and take the form of solenoids or motors having shaft linkages 81. The actuator shaft linkages 81 are coupled to the valve elements 76 to control their movement, and provide linear or rotary inputs for operation of the valve elements, the latter being via a suitable rotary to linear converter.

Power for operation of the actuators 70 is provided by the battery packs 67*a*, 67*b* via the connector elements 68*a*, 68*b*. As shown in FIG. 5, the connector elements 68 are located within seal bore assemblies 90 mounted within bores 92 of the devices 50, 54. Ends 98 of the connector elements 68*a*, 68*b* make electrical connection with sockets 99, which transmit power to the actuators 70. Operation of the actuators 70 causes the actuator shaft linkage 81 to translate the valve elements 76 out of sealing engagement with the valve seat 78. When it is desired to return the valves 74 to their closed positions, the actuators 70 are deactivated and return springs (not shown) urge the valve elements 76 back into sealing abutment with their valve seats 78.

The structure and operation of both the valves 74 and actuators 66 are in most respects similar to that disclosed in WO-2011/004180, the disclosure of which is incorporated herein by way of reference. Accordingly, these components will not be described in further detail herein.

Figure 2:
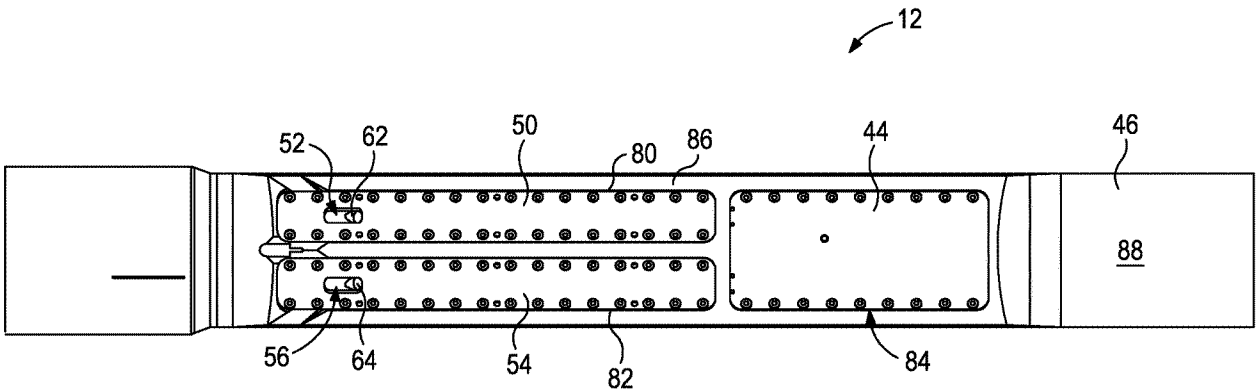
FIGS. 2 and 3 are enlarged, detailed side and perspective views, respectively, of the apparatus shown in FIG. 1.
Figure 3:
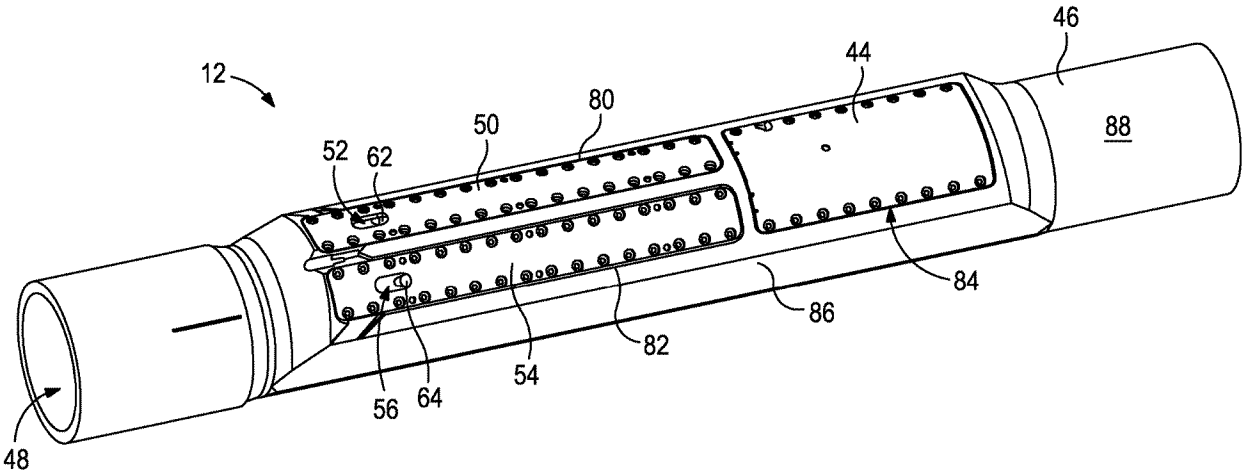

As shown in FIGS. 2 & 3 the first and second devices 50 and 54 are mounted in respective spaces 80 and 82 provided in the wall 60 of the tubular housing 46. The operating unit 44 is similarly mounted in a space 84 the housing wall 60, which is separate from the spaces 80, 82 in which the first and second devices 50, 54 are mounted but which opens on to them. As shown, the devices 50, 54 and the operating unit 44 are mounted entirely within the respective spaces 80, 82 and 84. The spaces 80, 82 and 84 have openings which are on or in an external surface of the housing, facilitating insertion of the device 50, 54 and the operating unit 44 into the spaces. The tubular housing 46 defines an upset or shoulder 86, which is upstanding from a circumferential outer surface 88 of the housing, and which define the spaces 80, 82 and 84. This facilitates provision of an internal passage 48 of unrestricted diameter extending along the length of the housing 46, e.g. for the passage of tools or tubing downhole past the apparatus 12.

The first and second devices 50, 54 and indeed the operating unit 44 are in the form of cartridges or inserts which can be releasably mounted in the tubular housing, in the spaces 80, 82 and 84. The cartridges of the first and second devices 50, 54 and operating unit 44 are shaped so that they are entirely mounted within the respective spaces 80, 82 and 84. The cartridges of the first and second devices 50, 54 house the respective valves 74. The first and second devices 50 and 54 also define part of the respective flow paths 52 and 56, the flow paths extending from the inlets 58 in the housing wall 60, through the valves 74 to the outlets 62 and 64. Operation of the valves 74 thereby controls the flow of fluid along the flow paths 52, 56 from the inlets 58 to the respective outlets 52, 56 to generate pulses. Positive or negative fluid pressure pulses may be generated by the devices 50, 54. Positive pulses are generated by operating the devices 50, 54 to close the respective flow paths 52, 56, and negative pulses by operating the devices to open the flow paths (as described above).

In use, the generation of fluid pressure pulses may be achieved without restricting a bore of the primary fluid flow passage, particularly where the outlets 62, 64 open to the exterior of the housing 46. The generation of positive or negative pulses may be controlled by appropriate direction of fluid to an exterior of the housing 46, or back into the internal flow passage 48. The direction of fluid back into the internal flow passage 48 may require the existence of a restriction (not shown) in the fluid flow passage 48.

Whilst the apparatus of the present invention has been shown and described in the transmission of data to surface relating to compressive load applied to a wellbore-lining tubing, it will be understood that the apparatus has a wide range of uses including in the drilling and production phases, or indeed in an intervention operation (e.g. to perform remedial operations in the well following commencement of production). Accordingly, the apparatus may have a use in transmitting data relating to other parameters pertinent to the drilling, completion or production phases and/or in an intervention. Such may include but are not limited to data relating to inclination, azimuth, pressure, temperature, resistivity, density, torque (such as torque on bit (TOB) or in wellbore tubing), strain, stress, acceleration and weight on bit (WOB).

Various modifications may be made to the foregoing without departing from the spirit or scope of the present invention.

For example, the apparatus may comprise at least one further device for controlling the flow of fluid along a further flow path which communicates with the internal fluid flow passage, to generate a further fluid pressure pulse. This may match the first and second pulses. In this way, a pulse of greater magnitude can be outputted by the apparatus, which is the sum of the pulses generated by the first, second and further devices. Alternatively the further device can be operated in one of the alternative operating conditions discussed above. If desired, four or more such devices may be provided and so arranged. The further device(s) may have any of the features set out herein in relation to the first/second devices.

The outlets of each flow path may open on to the internal fluid flow passage at a position which is spaced axially along a length of the housing from the respective inlet.

A separate upset or shoulder component may be provided which defines the space or spaces for the devices/actuator, and which can be coupled to the housing.

What is claimed is:

1. A method of generating a fluid pressure pulse downhole, the method comprising:

locating an elongate tubular housing defining an internal fluid flow passage in a well;

releasably mounting a first device in a first space provided in a wall of the housing, the first device including a first valve having a first valve element and a first valve seat, the first valve being actuatable to control a flow of fluid along a first flow path that communicates with the internal fluid flow passage;

releasably mounting a second device in a second space provided in the wall of the housing, the second device including a second valve having a second valve element and a second valve seat, the second valve being actuatable to control a flow of fluid along a second flow path that communicates with the internal fluid flow passage;

operating the first and second devices to control the flow of fluid along the first and second flow paths, respectively, and thereby generating a corresponding first fluid pressure pulse with a first pulse magnitude and a corresponding second fluid pressure pulse with a second pulse magnitude; and reinforcing the first fluid pressure pulse with the second fluid pressure pulse to generate a combined pressure pulse with a combined pulse magnitude greater than the first pulse magnitude or the second pulse magnitude.

2. The method of claim 1, further comprising operating the first and second devices simultaneously.

3. The method of claim 1, further comprising generating the first and second fluid pressure pulses with the same pulse profile and thereby generating the combined fluid pressure pulse.

4. The method of claim 1, further comprising transmitting data relating to at least one downhole parameter to surface via the first and second fluid pressure pulses.

* * * * *